US010362886B2

(12) United States Patent
Bellar et al.

(10) Patent No.: US 10,362,886 B2
(45) Date of Patent: Jul. 30, 2019

(54) SMALL ITEM OVERSTOCK STORAGE SYSTEM

(71) Applicant: Walmart Apollo, LLC, Bentonville, AR (US)

(72) Inventors: Jason Bellar, Bella Vista, AR (US); Mark Propes, Bentonville, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/836,432

(22) Filed: Dec. 8, 2017

(65) Prior Publication Data

US 2018/0184816 A1 Jul. 5, 2018

Related U.S. Application Data

(60) Provisional application No. 62/440,634, filed on Dec. 30, 2016.

(51) Int. Cl.
*A47F 5/00* (2006.01)
*A47F 5/08* (2006.01)
(Continued)

(52) U.S. Cl.
CPC ..... *A47F 5/132* (2013.01); *A47B 47/0091* (2013.01); *A47F 5/005* (2013.01);
(Continued)

(58) Field of Classification Search
CPC ..... A47F 5/132; A47F 5/0025; A47F 5/108; A47F 5/0031; A47F 5/01; A47F 5/13; A47F 3/14; A47F 7/145; A47F 5/0062; A47F 5/0065; A47F 5/16; A47F 7/148; A47F 7/143; A47F 5/08; A47F 5/005; A47F 5/083; A47B 47/0091; A47B 47/03;
(Continued)

(56) References Cited

U.S. PATENT DOCUMENTS 1,257,528 A * 2/1918 Plank ..... B42F 17/12 211/11
1,460,185 A * 6/1923 Webster ..... A47F 7/145 206/741

(Continued)

OTHER PUBLICATIONS

"Rev-A-Shelf 20.75-in W×18.12-in H Metal 2-Tier Cabinet Cookware Organizer", Lowes.com, accessed Nov. 17, 2016 (2 pp).

(Continued)

*Primary Examiner* — Jennifer E. Novosad
(74) *Attorney, Agent, or Firm* — Venable LLP; Jeffri A. Kaminski

(57) ABSTRACT

A tiered storage system which sits atop a gondola shelf. The tiered storage system is made of a support structure having gondola shelf connectors, the gondola shelf connectors configured to removeably attach the support structure to the gondola shelf, and two or more tiers mounted on the support structure, each tier including a horizontal plane and a vertical plane, the horizontal plane being substantially perpendicular to the vertical plane. The tiered storage system can be configured with pegs or other organizational tools for helping arrange items such that surplus items being stored on the tiered storage system can be visible to customers or associates in a store aisle.

12 Claims, 7 Drawing Sheets

(51) Int. Cl.

| | |
|---|---|
| ***A47F 5/10*** | (2006.01) |
| ***A47F 5/13*** | (2006.01) |
| ***A47B 47/00*** | (2006.01) |
| ***A47B 47/03*** | (2006.01) |
| ***A47B 57/40*** | (2006.01) |

(52) U.S. Cl.
CPC ..... *A47F 5/0025* (2013.01); *A47F 5/0031* (2013.01); *A47F 5/0062* (2013.01); *A47F 5/083* (2013.01); *A47F 5/108* (2013.01); *A47B 47/03* (2013.01); *A47B 57/402* (2013.01)

(58) Field of Classification Search
CPC ..... A47B 57/402; A47B 55/02; A47L 15/505; A47J 47/16
USPC ..... 211/187, 10, 11, 52, 55, 85.31, 181.1, 211/85.26, 126.1, 126.2, 126.9, 126.13, 211/128.1, 133.2, 133.5, 133.6, 106, 211/106.01, 184
See application file for complete search history.

(56) References Cited

U.S. PATENT DOCUMENTS 1,594,754 A * 8/1926 Reines ..... A47F 7/145 108/61
1,745,164 A * 1/1930 Griffith ..... A47F 7/28 108/23
1,848,214 A * 3/1932 Brown ..... A47F 7/0071 211/128.1
1,903,936 A * 4/1933 Nunnery ..... A47F 7/146 211/128.1
2,087,421 A * 7/1937 Williams ..... A47F 5/13 211/128.1
2,537,565 A * 1/1951 Wolters ..... A47B 65/00 211/11
2,793,760 A * 5/1957 Zel ..... A47F 5/13 211/130.1
2,902,166 A * 9/1959 Bahr ..... A47B 47/02 211/11
2,913,124 A * 11/1959 Rubenstein ..... A47F 7/148 211/181.1
3,176,849 A * 4/1965 Peebles ..... B42F 17/02 211/11
3,244,288 A * 4/1966 Schreter ..... A47K 5/02 211/181.1
3,269,547 A * 8/1966 Chamberlin ..... A47B 57/58 108/60
3,519,320 A * 7/1970 Freedman ..... A47F 3/063 211/55
3,774,774 A * 11/1973 Menkel ..... A47F 7/0028 211/72
3,777,897 A * 12/1973 Gray ..... A47F 7/145 211/128.1
4,872,580 A * 10/1989 Fuller ..... A47F 5/005 211/45
4,955,677 A * 9/1990 Song ..... A47F 7/146 211/128.1
4,974,733 A * 12/1990 Evans ..... A47B 63/00 211/11
5,123,545 A * 6/1992 Hickman ..... G11B 23/0236 211/128.1
5,314,081 A * 5/1994 Carroll ..... A47B 87/005 211/11
5,485,928 A * 1/1996 Felton ..... A47F 7/145 211/128.1
5,657,880 A * 8/1997 Birnbaum ..... B42F 7/12 211/11
5,826,730 A * 10/1998 Stravitz ..... B42F 7/10 211/55
5,915,571 A * 6/1999 Czalkiewicz ..... A47F 7/145 211/128.1
5,996,812 A * 12/1999 Sokol, Jr. ..... B42F 7/10 211/11
6,105,796 A 8/2000 Buchanan et al.
6,116,436 A * 9/2000 Ferrucci ..... A47B 55/02 108/181
6,161,708 A * 12/2000 Myler ..... A47F 5/0031 211/106
6,170,677 B1 * 1/2001 Meltser ..... A47F 7/141 211/11
6,290,077 B2 9/2001 Sosso
6,412,648 B1 7/2002 Woolnough et al.
6,431,375 B2 * 8/2002 Spencer ..... A47F 7/148 211/106
6,439,399 B1 * 8/2002 Wegstein ..... A47F 7/145 211/128.1
6,530,485 B1 * 3/2003 Weber ..... A47F 7/145 211/128.1
D502,741 S * 3/2005 Bain ..... D19/86
6,883,671 B2 4/2005 Rushing
D550,285 S * 9/2007 Theodorides ..... D19/90
7,299,934 B2 11/2007 Hardy et al.
7,367,460 B2 * 5/2008 Hirsch ..... A47F 5/0025 211/11
7,581,650 B1 * 9/2009 Shen ..... A47F 7/145 211/55
7,886,916 B2 * 2/2011 Alyn ..... A47F 5/0807 211/189
7,900,784 B1 * 3/2011 Weigand ..... A47F 5/13 211/186
9,010,034 B2 * 4/2015 Plikat ..... E04B 2/7405 52/36.5
9,050,848 B2 * 6/2015 Tsai ..... B42F 7/10
9,215,939 B2 * 12/2015 Zobel ..... A47F 5/0823
2003/0234228 A1 * 12/2003 Johnson ..... A47F 5/01 211/40
2004/0074855 A1 * 4/2004 Wons ..... A47F 7/145 211/55
2005/0092699 A1 * 5/2005 Stravitz ..... B42F 17/02 211/11
2005/0133474 A1 * 6/2005 Nomoto ..... A47F 5/0062 211/128.1
2005/0139561 A1 * 6/2005 Ohkubo ..... A47F 5/0062 211/128.1
2006/0261023 A1 * 11/2006 Goth ..... A47F 7/145 211/128.1
2008/0078728 A1 * 4/2008 Hodge ..... A47F 5/0846 211/55
2010/0181267 A1 * 7/2010 Theisen ..... A47F 7/0042 211/45
2010/0314345 A1 * 12/2010 Hodge ..... A47F 5/0025 211/183
2012/0298550 A1 * 11/2012 Martin ..... A47F 5/0025 206/775
2016/0120305 A1 5/2016 Kassanoff et al.
2018/0184816 A1 * 7/2018 Bellar ..... A47F 5/132

OTHER PUBLICATIONS

"Supermarket display wire stacking basket, metal shelves", alibaba.com, accessed Nov. 17, 2016 (7 pp).

* cited by examiner

SMALL ITEM OVERSTOCK STORAGE SYSTEM

BACKGROUND

1. Technical Field

The present disclosure relates to a small item overstock storage system, and more specifically to a bleacher storage system which can engage with a gondola shelf to provide tiered storage options to standard shelving.

2. Introduction

Retail shelving systems are found in almost every store and supermarket. In most types of shelving, the shelving bays are held together by vertical, back panels which hold the individual shelves. In many cases, the vertical panels are plain, meaning just a flat surface, but perforated vertical panels are available which can allow pegboard hooks for hanging products. When the shelves are too full of products to store additional items, surplus items are often placed on the top shelf, and are referred to as "topstock." With small or pegged items, however, topstock storage systems fail to allow customers or associates in the store aisle to gauge how much product is available on the top shelf.

SUMMARY

A tiered storage system which sits atop a gondola shelf, comprising: a support structure having gondola shelf connectors, the gondola shelf connectors configured to removeably attach the support structure to the gondola shelf; and two or more tiers mounted on the support structure, each tier including a horizontal plane and a vertical plane, the horizontal plane being substantially perpendicular to the vertical plane.

A gondola storage system comprising: a vertical plane of a gondola shelf system; a horizontal shelf connected to the vertical plane; and a tiered shelf attachment, the tiered shelf attachment removeably attached to the horizontal shelf, the tiered shelf attachment comprising: a support structure having gondola shelf connectors, the gondola shelf connectors configured to removeably attach the support structure to the horizontal shelf; two or more tiers mounted on the support structure, each tier including a horizontal segment and a vertical segment, the horizontal segment being substantially perpendicular to the vertical segment; and a side support piece which connects the two or more tiers to the support structure.

A tiered storage system, comprising: a structure having connectors which connect to a gondola shelf to hold the structure in place on the gondola shelf, the connectors configured to removeably attach the structure to the gondola shelf; and two or more tiers mounted on the structure, each tier having a horizontal plane and a vertical plane, the horizontal plane being substantially perpendicular to the vertical plane.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

DETAILED DESCRIPTION

Figure 1:
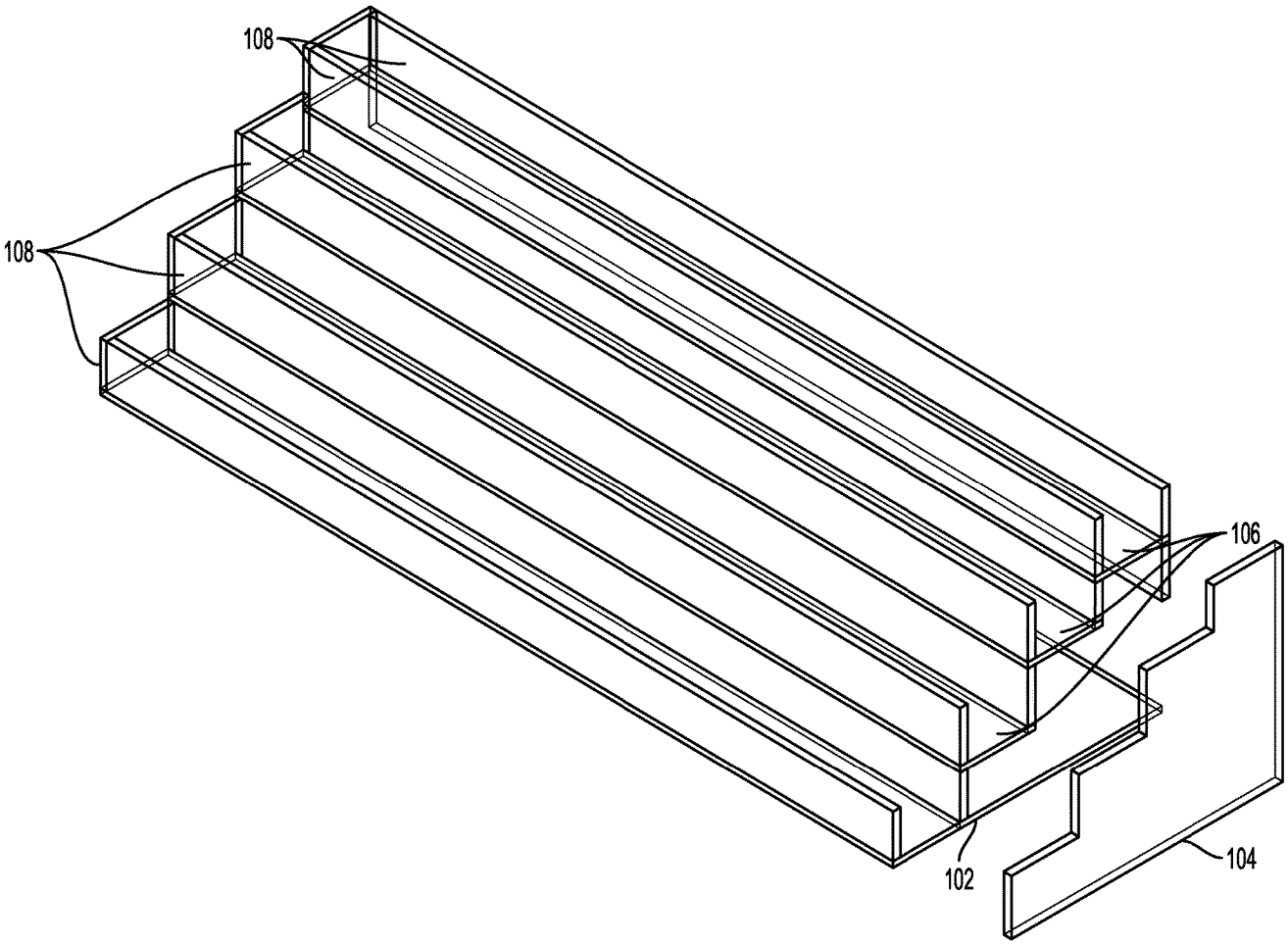
FIG. 1 illustrates a view of a first exemplary tiered storage system.

Current shelving systems do not provide for optimal storage of surplus small or pegged products. For example, for most products, any surplus items can be stored on the top shelf as topstock. However, with small items any surplus must first be boxed, then stored on the top shelf. Excess pegged items (those items which hang on pegs mounted to the shelving) must similarly be boxed, then stored on the top shelf. Such storage mechanisms do not allow a customer or store associate in the aisle to identify how many excess items may be stored in the boxes on the top shelf.

By contrast, the tiered overstock storage system of this disclosure can attach to a gondola shelf and provide a vertical element to the storage of items, thereby allowing improved viewing of stored products. Particularly with topstock storage, the tiered overstock storage system disclosed herein allows store associates and customers in an aisle to view items being stored in the tiered overstock storage unit, and thereby have an improved gauge the overall stock. Each tier of the storage system is made of a horizontal element and a vertical element which are substantially perpendicular to one another. In some configurations, the vertical element of each tier can extend vertically up above the horizontal element of the next higher tier. In other configurations, the vertical element of a lower tier will end at the horizontal element of the higher tier, forming a staircase/bleacher configuration. "Substantially" can be interpreted to be within 15° of the desired angle, and preferably within 5°.

The tiered storage system can have a first vertical plane at the lowest tier, next to the aisle (i.e., on the opposite side of the gondola shelf to which the tiered storage system is engaged from the vertical plane supporting the gondola shelf). The first vertical plane can help to form a catch for elements being stored in the tiered storage system. On the sides of the tired storage system can be side support structures. These side support structures can engage with an overall support structure, thereby allowing the overall tiered storage system to adequately support the tiers. The vertical plane of the top tier can be higher than the vertical plane of the next/lower tier, or can be the same height as the vertical plane of the next/lower tier.

The tiered storage system can be made using any available material. One exemplary material is wire, with each tier being formed using a grid, or weave, of the wire. Another exemplary material is polycarbonate, such as Lexan™. Other exemplary materials include steel, cold-rolled steel, stainless steel, and plastics.

On each tier can be smaller organizational tools incorporated into the tiered storage system. For example, on any given tier one or more dividers may be inserted to help organize or contain items. As another example, tiers may be configured to have pegs for the storage of pegged items. For example, if a tiered storage system were being configured to hold excess products which are normally hanging from a peg, the vertical plane associated with a given tier could have a peg attached to it, such that the excess products being stored may be stored on the peg of the tier. The dividers, pegs, or other organizational tools do not need to be evenly, or symmetrically, distributed across the tiered storage system. For example, half of an implemented tiered storage system can be for pegged items which use pegs, whereas the other half of the implemented tiered storage system can be non-pegged items. In other configurations, pegs can be present with dividers or other organization items.

The heights and depths of the respective tiers can be consistent between tiers, or can vary. For example, the first two tiers of a three tier storage system can have a first height, with the third tier having a greater height. Such a system could, for example, provide someone standing in the aisle with an improve view of items being stored on the third tier. In other configurations, each tier can have distinct widths of the horizontal planes. The widths or heights of the horizontal and vertical planes can be predetermined to fit the specific products which will be stored in them.

The support structure can engage with the horizontal shelf of the gondola storage system using "Christmas Tree" buttons, clamps, or any other mechanism. In one configuration, the four corners of the support structure each have a connector hole through which a Christmas tree button can be inserted. In other configurations, there can be more or less connector locations, as required by specific needs of the support structure. Such connectors allow the tiered storage system to engage with the horizontal shelf of the gondola storage system, such that the tiered storage system is removably secure to the horizontal shelf. The tiered storage system can take up a width of an entire vertical plane of a gondola shelving unit, or can be a smaller size to accommodate specific circumstances and needs. For example, one configuration could see a tiered storage system as disclosed herein which only takes up half of a normal shelf.

Having discussed the overall concepts of embodiments of the invention, the disclosure now turns to the specific configurations and embodiments illustrated in FIGS. 1-7. While specific implementations are described, it should be understood that this is done for illustration purposes only. Other components and configurations may be used without parting from the spirit and scope of the disclosure.

FIG. 1 illustrates a view of a first exemplary tiered storage system. As illustrated, the tiered storage system has a support structure 102 which sits upon a horizontal shelf. The support structure 102 can be further augmented by side support structures 104 on either side of the tiered storage system. The support structure 102 and the side support structure 104 together can support tiered horizontal planes 106 and tiered vertical planes 108. As illustrated, the tiered storage system has vertical planes 108 which extend higher than the horizontal plane of the next, higher, tier. In addition, the tiered storage system illustrated has a first vertical plane which can help hold products on the tiered storage system. The last vertical plane, located at the back of the tiered storage system, in this case matches the height of the ante-ultimate vertical plane. In other configurations, the last vertical plane can be higher than the ante-ultimate vertical plane.

The material used to construct the tiered storage system as illustrated in FIG. 1 can be a plastic, glass, metal, steel, or a polycarbonate such as Lexan™. The material can be uniform throughout the structure, or can vary. For example, the horizontal planes 106 can be of a same material, or a distinct material, as that of the vertical planes 108. Similarly, the support structure 102 can be made of a same or distinct material than that of the side support structure 104.

Figure 2:
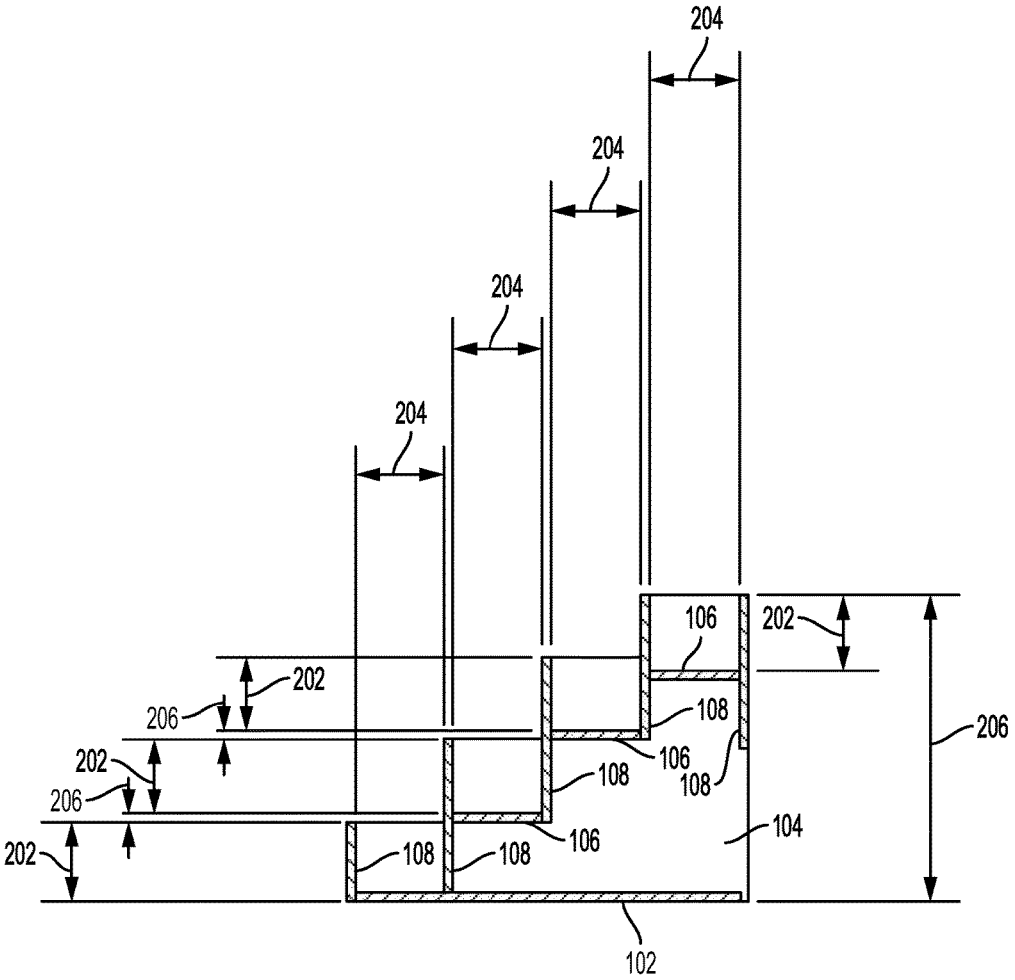
FIG. 2 illustrates a side view of the first exemplary tiered storage system.

FIG. 2 illustrates a side view of the first exemplary tiered storage system, with the support structure 102, the side support structure 104, the respective horizontal planes 106, and the respective vertical planes 108. FIG. 2 also illustrates the respective heights 202 and widths 204 of the tiers. In this illustration, each tier has a height 202, where each subsequent tier is further separated by the height 206 of the horizontal plane 106, resulting in a total height 206 of the tiered storage structure. Similarly, each tier has a width 204, similarly separated by the width of the vertical planes 108. It is noted that the horizontal planes 106, the vertical planes 108, the support structure 102, and the side support structure 104 can all be distinct structures, or can be a single indivisible structure. For example, the entire tiered storage system may be formed using a 3D printer or otherwise formed such that the pieces are a single structure. While the specific heights 202 and widths 204 can vary, exemplary values can be a 3 inch (7.62 cm) height 202 and a 3¾ inch (9.525 cm) width 204, with an overall height 206 of 12 inches (30.48 cm).

Figure 3:
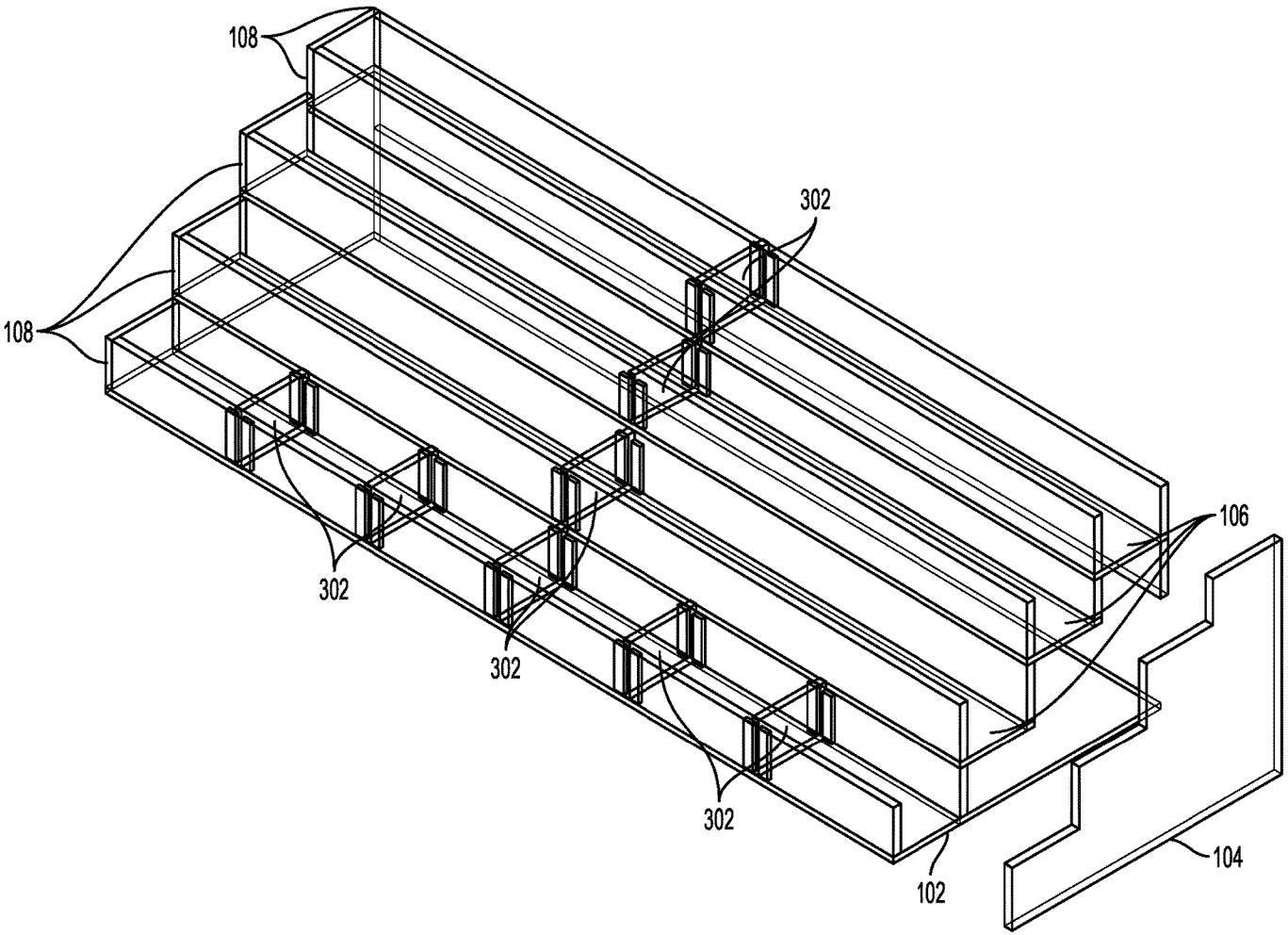
FIG. 3 illustrates a view of the first exemplary tiered storage system with dividers.

FIG. 3 illustrates a view of the first exemplary tiered storage system with dividers 302. As illustrated, the first tier has five dividers 302, whereas each subsequent tier has a single divider 302. In other configurations, the placement of the dividers and the number of dividers can vary. The material for the dividers can be the same material used to form the tiered storage structure, or can be a distinct material. As illustrated, the dividers have guides which hold the dividers 302 in place. In other configurations, the guides are not necessary. In yet other configurations, the guides are formed as part of the vertical planes 108, such that the dividers can easily be inserted when desired.

Figure 4:
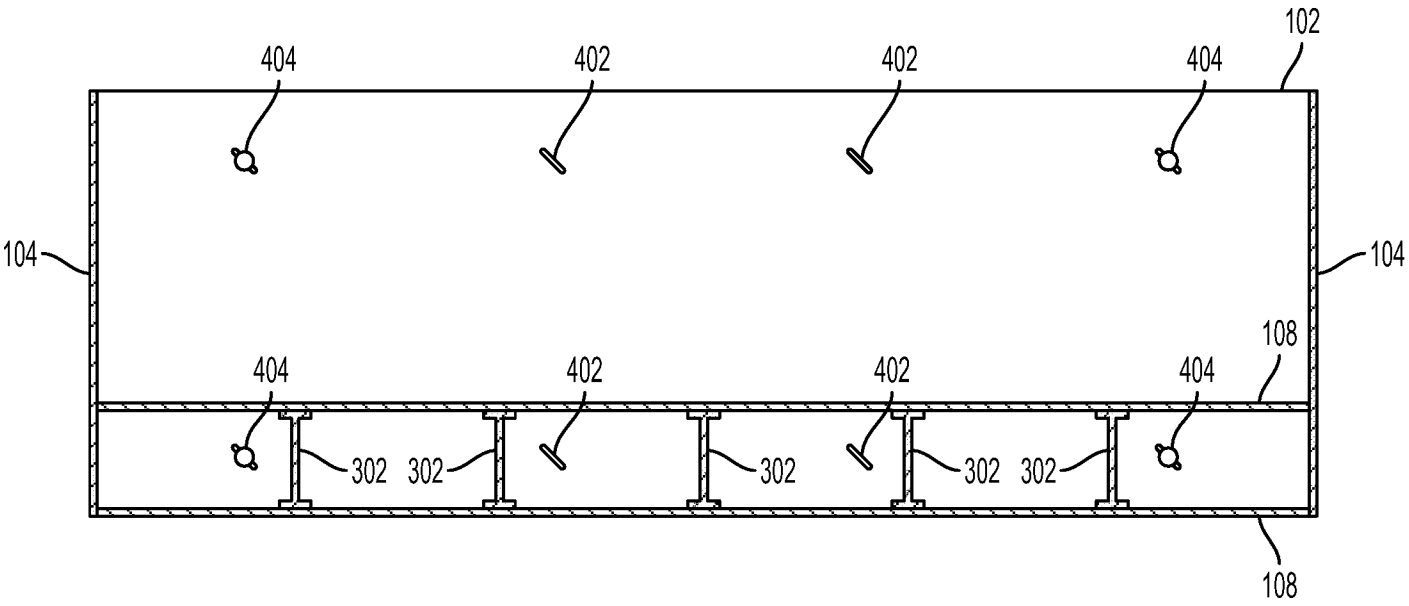
FIG. 4 illustrates a top view of a support structure for the first exemplary tiered storage system with dividers.

FIG. 4 illustrates a top view of a support structure 102 for the first exemplary tiered storage system with dividers 302. In this example, the support structure 102 has a number of holes 402, 404 for engaging with a horizontal shelf of a gondola storage system. The horizontal shelf may be provided with a corresponding element to engage with the support structure 102. In this example, some of the holes 404 are filled with connectors which help make the support structure 102 removeably secure. The connectors can be screws, bolts, Christmas tree connectors, or any other type of securing mechanism capable of traversing the plane of the support structure 102 and the plane of the horizontal shelf.

Figure 5:
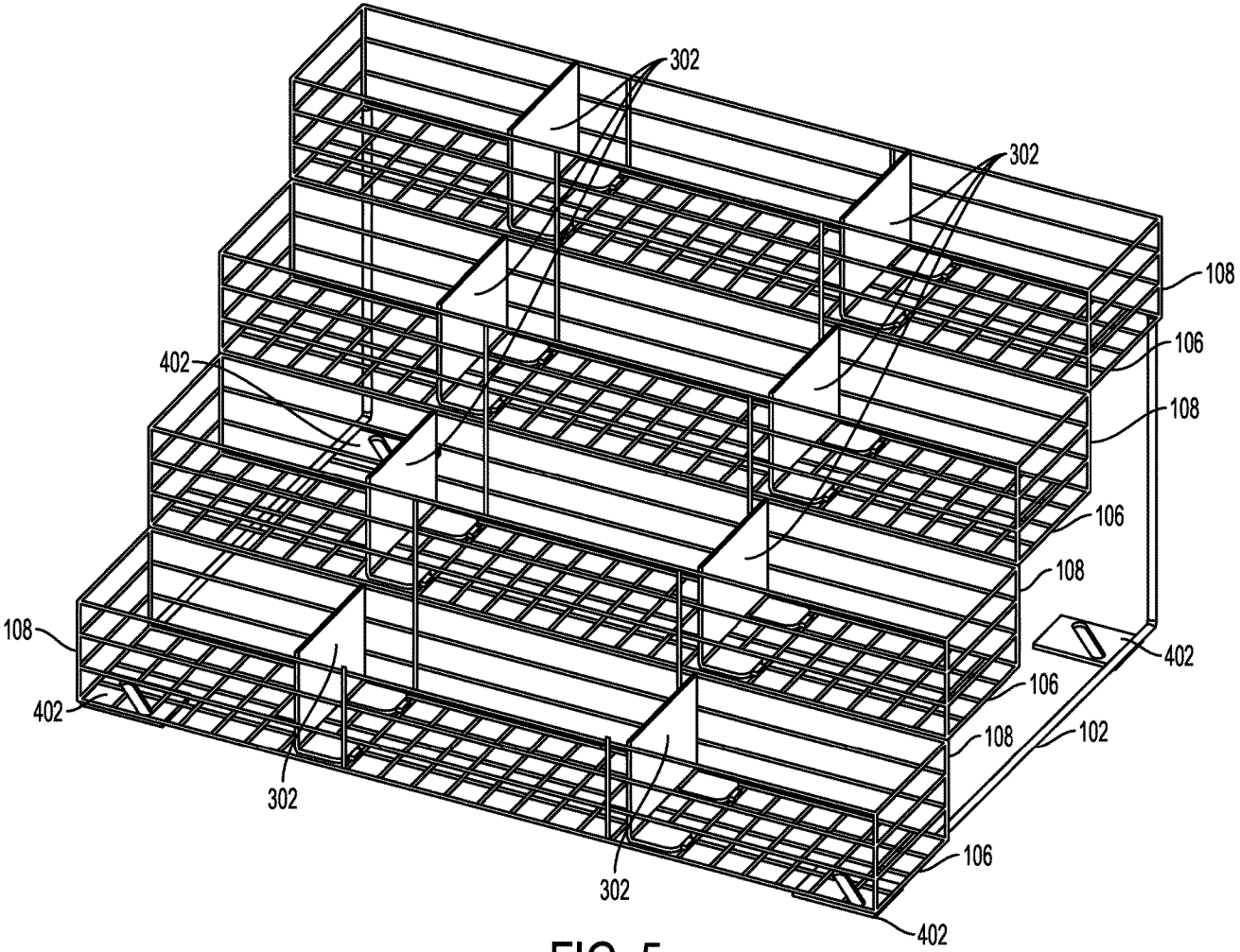
FIG. 5 illustrates a view of a second exemplary tiered storage system.

FIG. 5 illustrates a view of a second exemplary tiered storage system. In this example, the support structure 102, the vertical planes 108, and the horizontal planes are made out of wire shaped into grids. The spacing of the grid can vary, such that products cannot accidently roll out of, or otherwise fall out of, the tiered storage system. Exemplary gaps within the grid can be ⅓ inch (0.8382 cm), ½ inch (1.27 cm), ¾ inch (1.905 cm), 1 inch (2.54 cm), or any other gap width capable of preventing products from unintentionally escaping the tiered storage system. The support structure has holes 402 for connectors to engage with the horizontal shelf of the gondola shelving system, but unlike the previous example, the support structure 102 of this example is hollow. The dividers 302 in this example are adjustable along the horizontal planes 106, such that store associates can adjust the dividers 302 as required.

Figure 6:
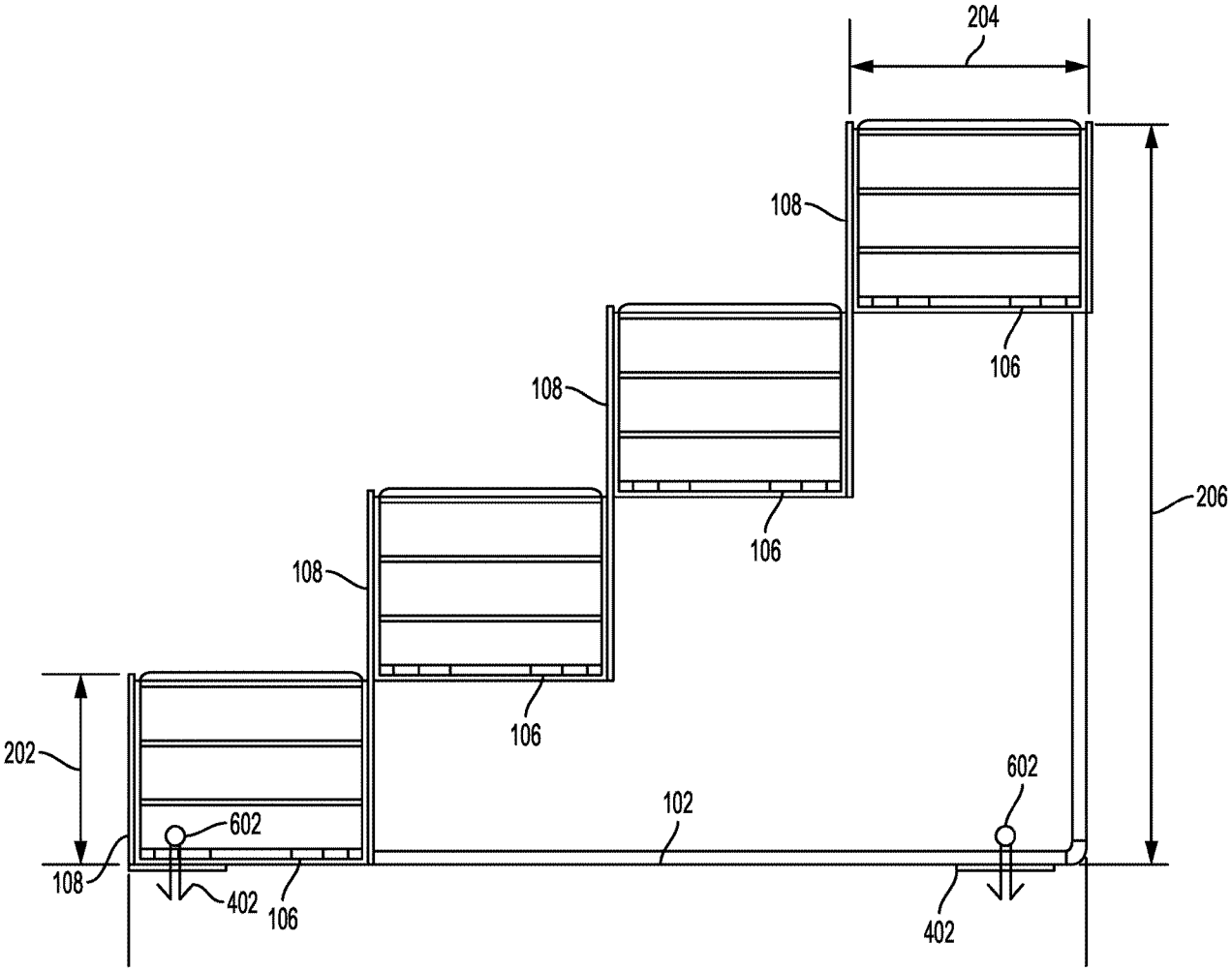
FIG. 6 illustrates a side view of the second exemplary tiered storage system.

FIG. 6 illustrates a side view of the second exemplary tiered storage system, with the support structure 102, the horizontal planes 106, and the vertical planes 108 showing a similar overall structure to that of the first exemplary tiered storage system side view illustrated in FIG. 2. As described in FIG. 2, the heights 202 and widths 204 of the respective tiers can be identical between the tiers, or can vary according to specific needs or configurations. Also illustrated in FIG. 6 are the connectors 602 which engage with the horizontal shelf of the gondola shelving system to secure the tiered storage system in place, such that the tiered storage system is removeably secure with respect to the horizontal shelf.

Figure 7:
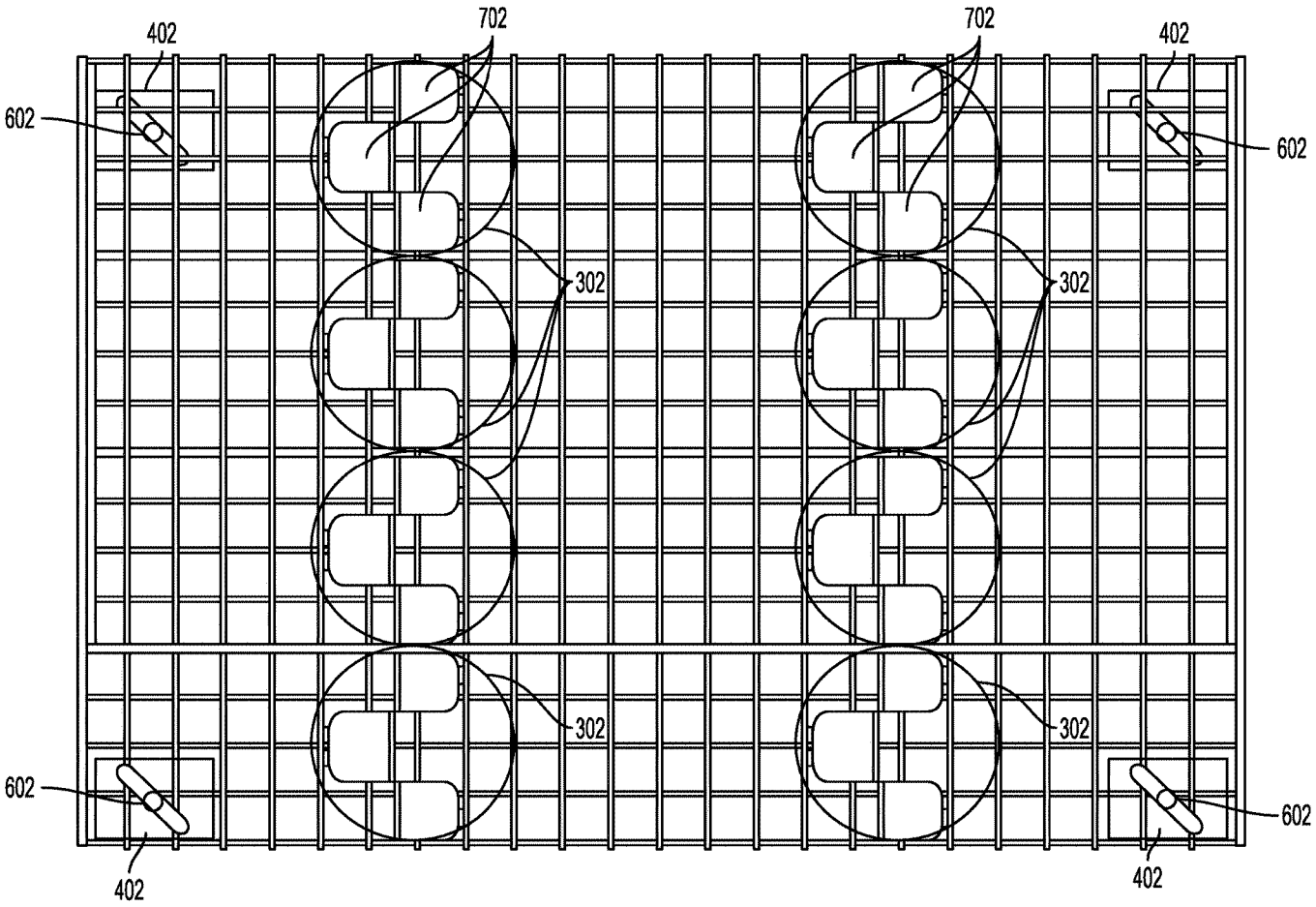
FIG. 7 illustrates a top view of the second exemplary tiered storage system.

FIG. 7 illustrates a top view of the second exemplary tiered storage system. In this view, the connector holes 402 are visible, with accompanying pegs 602, as are the multiple engagement mechanisms of the dividers 302. Each divider 302 illustrated has three respective lips 702 which help balance the divider within the wire frame tiers. Each respective lip 702 can have a hook which engages with the wire frame to lock the divider 302 in place. In this manner, the dividers 302 can be moved horizontally to any desired location within the respective tiers, or removed altogether from the tiered storage structure.

The various embodiments described above are provided by way of illustration only and should not be construed to limit the scope of the disclosure. For example, while many of the examples given herein are associated with surplus products stored as topstock, the tiered storage system disclosed herein can be used in other locations than the top shelf of a gondola storage shelf. Various modifications and changes may be made to the principles described herein without following the example embodiments and applications illustrated and described herein, and without departing from the spirit and scope of the disclosure.

We claim:

1. A tiered storage system which sits atop a horizontal gondola shelf, comprising:

a support structure having gondola shelf connector holes located at each corner of a base of the support structure, the gondola shelf connector holes removeably attaching the support structure to the horizontal gondola shelf using connectors which respectively pass through a gondola shelf connector hole and a hole of the horizontal gondola shelf, the respective gondola shelf connector hole being aligned with the hole of the horizontal gondola shelf; and two or more tiers mounted on the support structure, each tier including a horizontal plane and a vertical plane, the horizontal plane being substantially perpendicular to the vertical plane, and each tier in the two or more tiers having an identical width between tiers, wherein the support structure, the vertical plane, and the horizontal plane of each tier in the two or more tiers are formed using wire.

2. The tiered storage system of claim 1, wherein the gondola shelf connector holes are located on tabs extending from the wire at the each corner of the base of the support structure.

3. The tiered storage system of claim 1, further comprising a plurality of dividers removeably attached to the horizontal plane of each tier in the two or more tiers.

4. The tiered storage system of claim 1, wherein the vertical plane of each tier in the two or more tiers extends higher than the horizontal plane of a next higher tier.

5. The tiered storage system of claim 4, wherein the vertical plane of each tier in the two or more tiers contains pegs.

6. A gondola storage system comprising:

a vertical plane of a gondola shelf system;

a horizontal shelf connected to the vertical plane; and a tiered shelf attachment made of wire, the tiered shelf attachment removeably attached to the horizontal shelf, the tiered shelf attachment comprising:

a support structure having gondola shelf connectors located at each corner of a base of the support structure, the gondola shelf connectors configured to removeably attach the support structure to the horizontal shelf by passing through a gondola shelf connector hole and a hole of the horizontal shelf, the respective gondola shelf connector hole being aligned with the hole of the horizontal shelf;

two or more tiers mounted on the support structure, each tier including a horizontal segment and a vertical segment, the horizontal segment being substantially perpendicular to the vertical segment, each tier in the two or more tiers having an identical width between tiers;

a side support piece which connects the two or more tiers to the support structure;

a plurality of dividers removeably attached to the horizontal segment of each tier in the two or more tiers, each divider in the plurality of dividers held in place by tabs which extend under the horizontal segment of the tier in which the divider is located.

7. The gondola storage system of claim 6, wherein there are three tabs for each divider.

8. The gondola storage system of claim 7, wherein the wire is formed into a grid, and the three tabs extend in parallel to the grid from a respective divider, with one of the three tabs extending in an opposite direction from the respective divider than the other two tabs.

9. The gondola storage system of claim 6, wherein the vertical segment of each tier extends higher than the horizontal segment of a next higher tier.

10. The gondola storage system of claim 9, wherein the vertical segment of each tier in the two or more tiers contains pegs.

11. A tiered storage system, comprising:

a structure having connectors which connect to a horizontal gondola shelf to hold the structure in place on the horizontal gondola shelf, the connectors configured to removeably attach the structure to the horizontal gondola shelf, the connectors located at each corner of a base of the structure;

two or more tiers mounted on the structure, each tier having a horizontal plane and a vertical plane, the horizontal plane being substantially perpendicular to the vertical plane, and each tier in the two or more tiers having an identical width between tiers; and a plurality of dividers removeably attached to the horizontal plane of each tier in the two or more tiers, each divider in the plurality of dividers held in place by tabs which extend under the horizontal plane of the tier in which the divider is located, wherein the structure, the vertical plane, and the horizontal plane of each tier in the two or more tiers are formed using wire, wherein the wire is formed into a grid, wherein there are three tabs for each divider and the three tabs extend in parallel to the grid from a respective divider, with one of the three tabs extending in an opposite direction from the respective divider than the other two tabs, the structure being removeably attached to the horizontal gondola shelf using connectors which respectively pass through a gondola shelf connector hole and a hole of the horizontal gondola shelf, the respective gondola shelf connector hole being aligned with the hole of the horizontal gondola shelf.

12. The tiered storage system of claim 11, wherein the vertical plane of each tier extends higher than the horizontal plane of a next higher tier.

* * * * *